US006719442B1

(12) United States Patent
Chen

(10) Patent No.: US 6,719,442 B1
(45) Date of Patent: Apr. 13, 2004

(54) SOLAR FUNNEL SHAPED REFLECTOR

(75) Inventor: Chi-Gon Chen, Guang Zhou (CN)

(73) Assignee: International Development Corporation, Southlake, TX (US)

( * ) Notice: Subject to any disclaimer, the term of this patent is extended or adjusted under 35 U.S.C. 154(b) by 0 days.

(21) Appl. No.: 09/989,229

(22) Filed: Nov. 20, 2001

(51) Int. Cl.[7] ..... F21V 5/04; F21V 7/06
(52) U.S. Cl. ..... 362/328; 362/333; 362/338
(58) Field of Search ..... 362/255, 307, 362/308, 327, 328, 329, 333, 334, 335, 336, 338, 356, 361, 347

(56) References Cited

U.S. PATENT DOCUMENTS

| | | | | | |
|---|---|---|---|---|---|
| 1,177,076 | A | * | 3/1916 | White | 362/307 |
| 1,682,490 | A | * | 8/1928 | Dressler | 362/335 |
| 3,633,022 | A | * | 1/1972 | Knut et al. | 362/328 |
| 4,186,433 | A | | 1/1980 | Baldwin | 362/263 |
| 4,731,713 | A | | 3/1988 | Perthus | 362/302 |
| 4,920,469 | A | | 4/1990 | Harding | 362/300 |
| 5,436,808 | A | | 7/1995 | Noponen | 362/61 |
| 6,004,003 | A | * | 12/1999 | Dalton et al. | 362/327 |
| 6,193,383 | B1 | * | 2/2001 | Onikiri et al. | 362/327 |

* cited by examiner

*Primary Examiner*—Y. My Quach-Lee
(74) *Attorney, Agent, or Firm*—Kenneth T. Emanuelson; Gardere Wynne Sewell LLP

(57) ABSTRACT

The present invention provides an illumination device having a curved reflector for use with a light-emitting device. The illumination device includes conical or funnel shaped lens having a top section, a bottom section, an outer surface and an inner surface. The bottom section is enlarged and contains a hollow interior formed by the lens inner surface to receive a curved reflector. The top section contains a cavity adaptable to receive a light-emitting device so that when the light is illuminated, light is transmitted through the reflector lens. As light travels towards the bottom section, the curved reflector deflects light in the horizontal direction through the lens to prevent light from being absorbed by the base. The reflector lens outer and inner surfaces contain ridges to form a grid-like pattern to disperse light. This configuration provides an efficient means to transmit light to illuminate a surrounding area.

20 Claims, 4 Drawing Sheets

SOLAR FUNNEL SHAPED REFLECTOR

TECHNICAL FIELD OF THE INVENTION

The present invention relates to a lens and reflector for use with a light-emitting device such as a lamp or lantern. More particularly, the present invention relates to a cone-like or funnel shaped lens and a curved reflector for reflecting and distributing light to illuminate surrounding areas.

BACKGROUND OF THE INVENTION

Reflectors are commonly used with light emitting devices in an attempt to reflect and focus light into a desired direction. This provides an energy efficient means to provide brighter light when illuminating surrounding areas.

While reflectors have proven useful in flashlights or automobile headlights, for example, reflectors are not effectively used in lanterns. Most lanterns support a light source in an area that has transparent sides to allow the light to be emitted to the surrounding area. However, in most instances, the top and bottom surfaces of the enclosed areas are opaque and absorb a majority of the light that reaches these surfaces. Thus, the amount of light illuminating the surrounding area is significantly reduced. As a result, if users desire brighter illumination, a higher wattage is required and more energy is consumed. This is undesirable especially when the lantern is powered by solar energy. In order to prevent the light from being absorbed, various designs have been devised, including using a highly reflective material to cover the top and bottom surfaces of the lantern enclosed area. This has proven inefficient because the light is not reflected in the desired direction. In most cases, light is reflected either directly up or down and not outward, where the light is most needed. There is a need to efficiently distribute light by using a specially shaped lens and reflector for use with a lantern.

SUMMARY OF THE INVENTION

The present invention relates to a reflector device for use with a lantern. The reflector includes a cone-like or funnel-shaped lens having a top section to receive a light emitting device and a bottom section to receive a curved reflector. The lens and reflector are supported and held together by a base structure.

The light-emitting device emits light into and through the lens thickness. Light propagates through the lens and is diffused to illuminate surrounding areas. The inner and outer surfaces of the reflector contain ridges to form surface irregularities to evenly disperse the light as it passes through the lens.

The lens bottom section includes a hollow interior configured to receive a curved/parabolic shaped cone-like reflector. By inserting the curved reflector in the lens bottom section, light that would ordinarily be absorbed by the base portion can be deflected outward from the lantern to illuminate surrounding areas. This configuration provides an efficient way to reflect and use the emitted light that would ordinarily be absorbed by the base structure.

The reflector device can be mounted on a lantern, lamp or any other device where it is desired to reflect light. The lens is fabricated from a transparent or translucent glass or plastic material capable of transmitting light. The curved reflector is most preferably fabricated from a highly reflective metallic material or a plastic plated with a reflective surface.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DETAILED DESCRIPTION OF THE INVENTION

Figure 1:
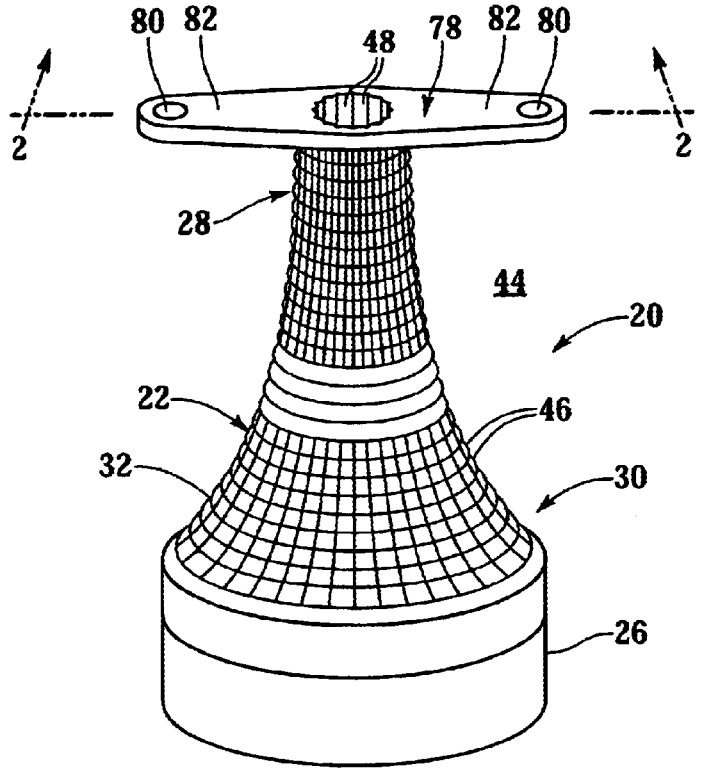
FIG. 1 is a perspective view of the illumination device of the present invention.
Figure 2:
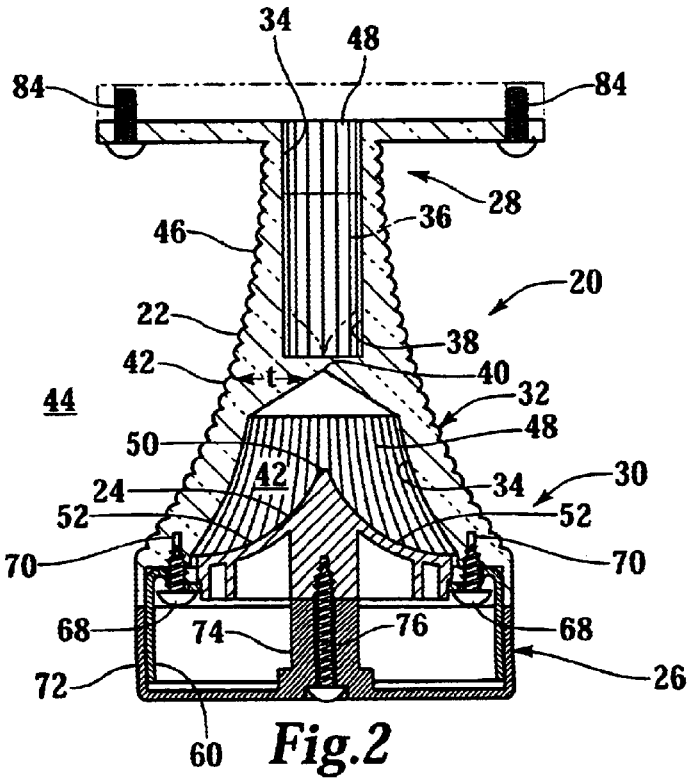
FIG. 2 is a section view taken along line 2—2 of FIG. 1.
Figure 3:
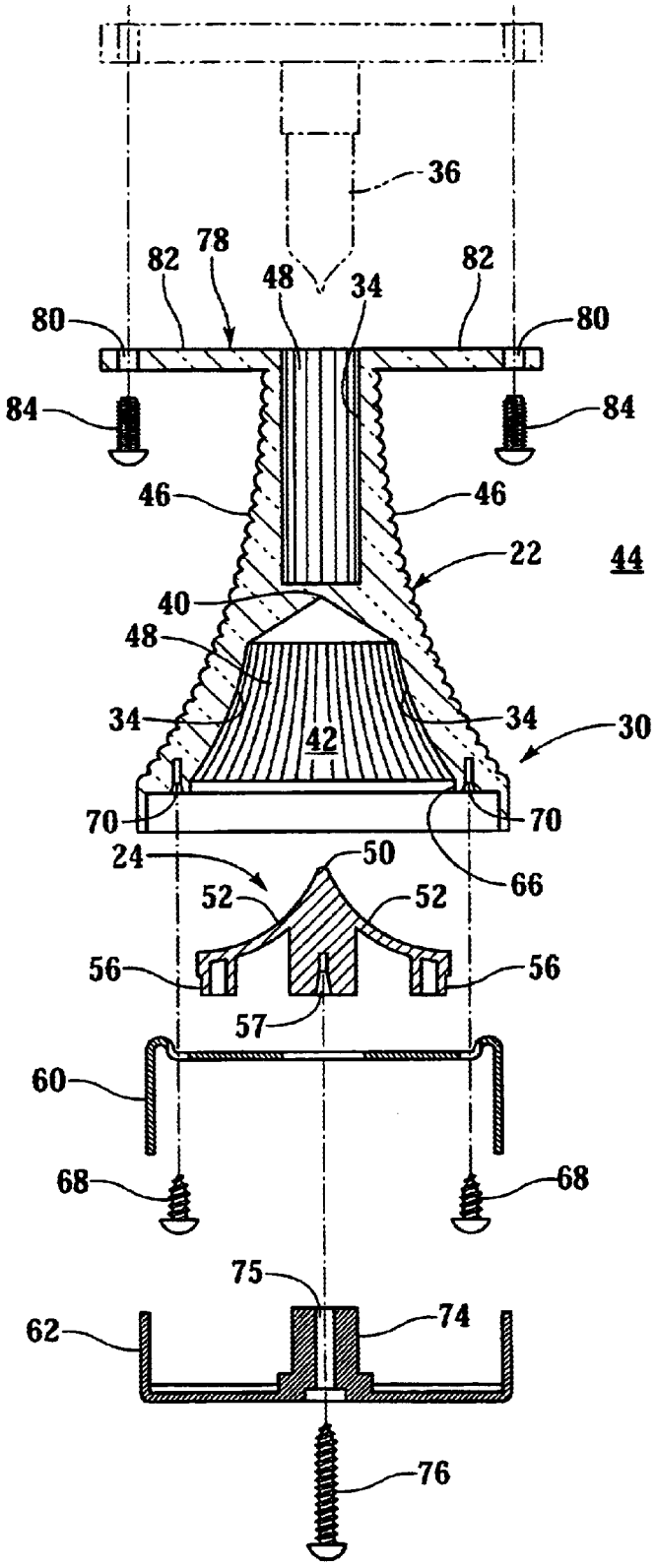
FIG. 3 is an exploded section view taken along line 2—2 of FIG. 1.

Referring to FIGS. 1, 2 and 3, illumination device 20 comprises generally a lens 22, a reflector 24 and a base 26.

Lens 22 is defined by a top section 28, a bottom section 30, an outer surface 32 and an inner surface 34, all forming a lens having a variable thickness "t". Lens 22 is generally shaped as a cone or a funnel with outer surface 32 having a slight curvature so that top section 28 has the smallest diameter and bottom section 30 has the largest diameter. A light-emitting device 36 is inserted into lens top section 28 and is housed inside a cavity 38, as best seen in FIG. 2. Cavity 38 is formed by lens inner surface 34 and extends inside lens 22 stopping adjacent an apex 40 of a hollow interior 42, located inside bottom section 30. As light 36 is illuminated, light is diffused through lens top portion 28 to illuminate a surrounding area 44.

Light waves not diffused through lens top section 28 propagate into lens bottom section 30. Bottom section 30 has an enlarged cross section and contains cavity or hollow interior 42 formed by lens inner surface 34. As light waves propagate into bottom section 30, light enters hollow interior 42 where it is reflected by reflector 24.

Referring to FIGS. 1–3, lens outer surface 32 and inner surface 34 contain a ridged surface to form a grid-like pattern to efficiently diffuse light. Most preferably, lens outer surface 32 contains parallel and horizontally spaced ridges 46 extending around the perimeter of lens 22. Lens inner surface 34 most preferably contain parallel and vertically spaced ridges 48; however, it should be noted that any configuration of ridged surfaces 46, 48 could be used to diffuse the light. Ridges 46 and 48 diffuse the light waves as they propagate through the lens body to evenly illuminate surrounding area 44. Lens 22 is most preferably fabricated from a transparent or translucent glass or plastic capable of transmitting light.

Figure 4:
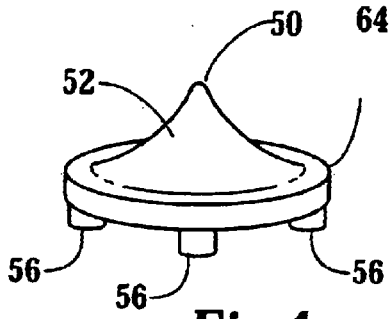
FIG. 4 is a perspective view of the conical shaped reflector.
Figure 5:
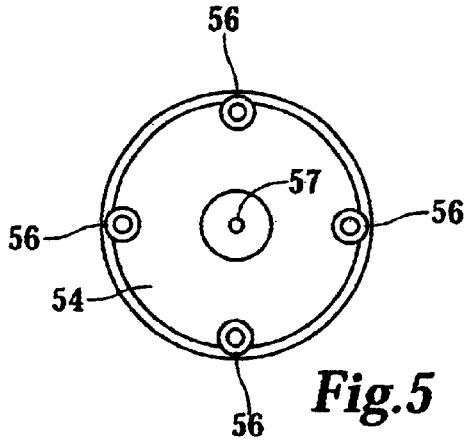
FIG. 5 is a bottom view of the conical shaped reflector.

Reflector 24 has a cone-like or inverted funnel-like shape. A top surface 52 of reflector 24 preferably tapers upwardly from its base at an increasing degree of steepness such that the outer surface has a generally parabolic slope that terminates at apex 50, which points upward toward top section 28. Referring to FIGS. 4 and 5, the curved shape of reflector top surface 52 is most preferably described by the parabolic curve $y=x^2$ when defined in a rectangular or Cartesian coordinate system. The cone-like appearance of top surface 52 generally resembles a solid of revolution whereby the solid is a region bounded by $y=0$, $y=x^2$ and $x=1$ and revolved 360 degrees around a vertical axis located at $x=1$. This parabolic/cone-like configuration permits light to reflect outwardly toward lens 22 to illuminate surrounding area 44. Alternate configurations of reflector top surface 52 may include, but are not limited to a hemispherical or pyramidal surface (not shown). Using the present invention without reflector 24 would result in substantial amounts of light being absorbed by base 26; thus, the brightness would be significantly reduced. Reflector 24 is preferably fabricated from plastic that is plated with a reflective material, such as aluminum, for example. Other embodiments may include a metal reflector having a highly reflective surface.

Figure 6:
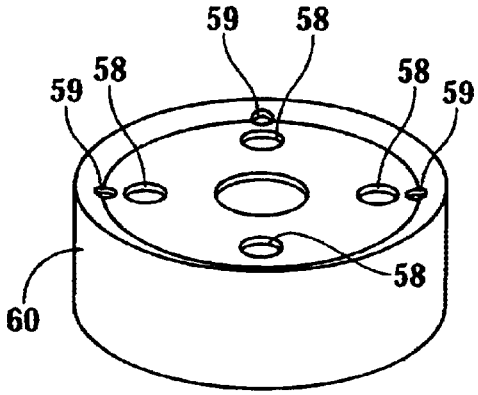
FIG. 6 is a perspective view of the mounting structure.

As best seen in FIGS. 4–6. protrusions 56 extend from reflector bottom surface 54 to engage with openings 58 on a reflector mount 60. Protrusions 56 stablize and prevent reflector 24 from rotating while installed inside hollow interior 42.

Figure 7:
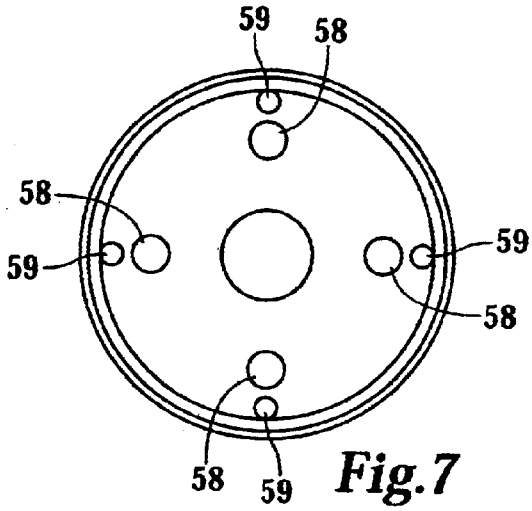
FIG. 7 is a top view of the mounting structure.

Reflector 24 is suppported by base structure 26, which attaches to the bottom surface of lens 22. Base structure 26 includes reflector mount 60 and cover 72 to fit over the outer surface of mount 60 (FIGS. 2 and 3). Mount 60, when properly aligned and adjacent to len 22, forms the bottom section of hollow chamber 42 and holds reflector 24 inside chamber 42, as best seen in FIG. 3. Edge 64 of reflector top surface 52 engages recessed annular surface 66 to align relfector apex 50 along the central axis of illumination device 20. Screws 68 are inserted inside openings 59 on mount 60 (FIGS. 6 & 7) and threadingly engage openings 70 located on lens 22.

Figure 8:
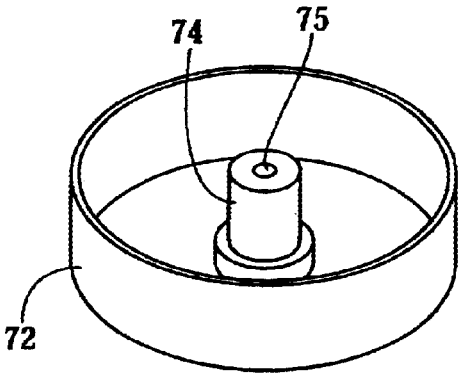
FIG. 8 is a perspective view of the base structure.
Figure 9:
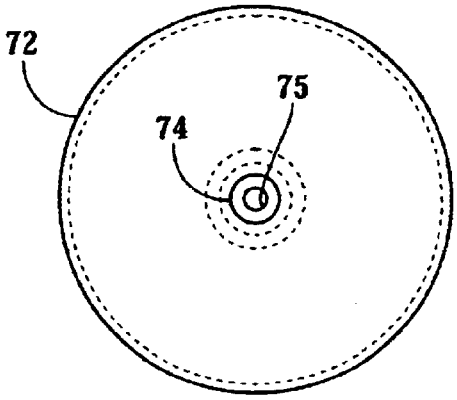
FIG. 9 is a bottom view of the base structure.
Figure 10:
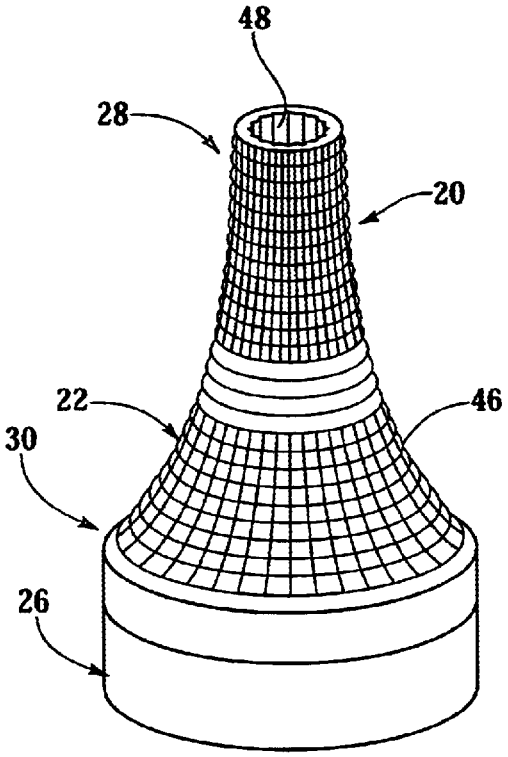
FIG. 10 is a right side perspective view of the illumination device without the mounting structure.
Figure 11:
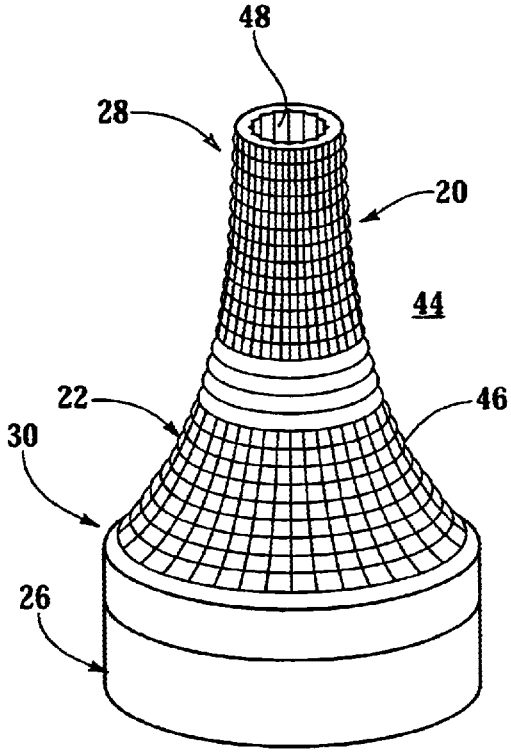
FIG. 11 is a left side perspective view of the illumination device without the mounting structure.
Figure 12:
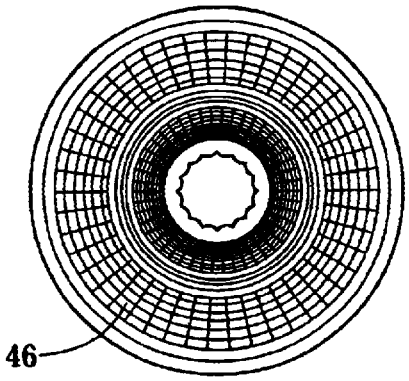
FIG. 12 is a top view of the illumination device without the mounting structure.
Figure 13:
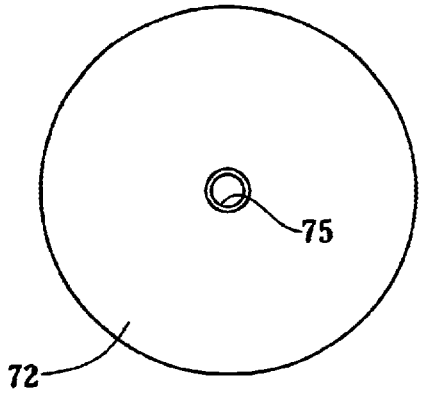
FIG. 13 is a bottom view of the illumination device without the mounting structure.

Cover 72 is optionally inserted over reflector mount 60 to enclose the bottom portion of mount 60. Referring to FIGS. 8 and 9, cover 72 contains a fastener mechanism 74, comprising a threaded opening 75 located in the center portion of the cover to receive a mounting screw 76 (FIGS. 2 and 3). Mounting screw 76 should be of sufficient length to extend through fastener mechanism 74 and into opening 57 located on reflector bottom surface 54. This prevents cover 72 from disengaging mount 60.

Top portion 28 or bottom portion 30 can be used to attach illumination device 20 to a lamp or lantern. When attaching top portion 28, a mounting member 78 is connected to lens 22 on top portion 28, as shown in FIGS. 1–3. In a preferred embodiment, mounting member 78 is a rigid member having a flat top surface with tapered ends forming arms 82. It is understood that any shaped mounting member would be sufficient, such as a circular rigid member attached to lens top portion 28. Mounting member 78 can be integrally molded, glued, bolted or the like to lens top surface 28 so that openings 80, located on each arm 82, can be aligned with openings located on the lantern (not shown). A mounting screw 84 is inserted inside each arm opening 80 to fasten illumination device 20 to the lantern.

If the lantern is configured to support illumination device 20 from the bottom, an opening on the lantern can be aligned with the fastener mechanism opening 75 and screw 76 can be inserted to attach illumination device 20 to the lantern. In this configuration, mounting member 78 is not necessary and can be removed, as seen in FIGS. 10–13.

Although preferred embodiments of the present invention have been illustrated in the accompanying drawings and described in the foregoing Detailed Description, it will be understood that the invention is not limited to the embodiments disclosed but is capable of numerous rearrangements, modifications, and substitutions of parts and elements without departing from the spirit of the invention.

I claim:

1. An illumination device to illuminate a surrounding area, the illumination device comprising:

a reflector having a circular base and a top surface wherein said top surface tapers upwardly from said circular base forming a parabolic curve with an increasing slope that terminates at an apex, wherein said apex is aligned along the center of said circular base, wherein said reflector is placed inside a lens for reflecting light;

said lens includes a top section, a bottom section, an outer surface and an inner surface wherein said outer and inner surfaces form said lens having a thickness;

said lens top section contains a cavity formed by said inner surface adaptable to receive a light emitting device; and said lens bottom section is enlarged and contains a hollow interior formed by said inner surface to receive said curved reflector with said apex mounted toward said top section to deflect light emitted from the light emitting device into said lens to illuminate the surrounding area.

2. The illumination device of claim 1, wherein the lens outer surface contains ridges to diffuse the light.

3. The illumination device of claim 1, wherein the lens inner surface contains ridges to diffuse light.

4. The illumination device of claim 1, wherein said lens top section further includes a mounting support to connect said reflector to a support structure.

5. The illumination device of claim 1, wherein said lens is glass or plastic capable of transmitting light.

6. The illumination device of claim 1 wherein said curved reflector is plastic containing a highly reflective plating material on its surface.

7. The illumination device of claim 1, wherein said curved reflector is a reflective metallic material.

8. The illumination device of claim 1 wherein said lens outer surface is curved having a funnel-like appearance.

9. The illumination device of claim 1 wherein said reflector and lens are supported by a base structure.

10. An illumination device to illuminate a surrounding area, the illumination device comprising:

a reflector mounted inside a funnel shaped lens wherein said reflector has a circular base and a curved top surface, said curved top surface tapers upward as a parabolic curve wherein said parabolic curve has an increasing slope forming an apex;

said funnel shaped lens includes a top section, a bottom section, an outer surface and an inner surface wherein said outer surface and said inner surface form said funnelshaped lens having a thickness to transmit light;

said top section is adaptable to receive a light emitting device; and said bottom section is enlarged receive said curved reflector wherein when said light emitting device is illuminated, light is reflected from said reflector top surface and through said lens to illuminate the surrounding area.

11. The illumination device of claim 10 wherein the outer lens surface contains ridges to diffuse the light.

12. The illumination device of claim 10, wherein the inner lens surface contains ridges to diffuse the light.

13. The illumination device of claim 10 wherein the lens top end further includes a mounting support to connect the illumination device to a support structure.

14. The illumination device of claim 10 wherein said lens is glass.

15. The illumination device of claim 10 wherein said lens is a transparent or translucent plastic.

16. The illumination device of claim 10 wherein the reflector is plastic and plated with a reflective material.

17. The illumination device of claim 10, wherein the reflector is a reflective metal.

18. The illumination device of claim 10, wherein said reflector further comprises alignment protrusions extending downward from said circular base.

19. The illumination device of claim 18, wherein said reflector and lens are supported by a reflector mount, the reflector mount further comprising openings to receive and engage said reflector alignment protrusions to stabilize and prevent said reflector from rotating.

20. The illumination device of claim 19, wherein a cover is adapted to be inserted over said reflector mount, said cover includes a fastener mechanism adapted to attach the illumination device to a lamp or lantern.

* * * * *